US011780718B2

(12) United States Patent
Ghirardi et al.

(10) Patent No.: US 11,780,718 B2
(45) Date of Patent: Oct. 10, 2023

(54) ACCESSORY MODULAR DEVICE FOR AGV

(71) Applicant: Comau S.p.A., Grugliasco (IT)

(72) Inventors: Ugo Ghirardi, Grugliasco (IT); Andrea Ascheri, Grugliasco (IT); Maurizio Pollano, Grugliasco (IT)

(73) Assignee: Comau S.p.A., Grugliasco (IT)

( * ) Notice: Subject to any disclaimer, the term of this patent is extended or adjusted under 35 U.S.C. 154(b) by 440 days.

(21) Appl. No.: 16/192,848

(22) Filed: Nov. 16, 2018

(65) Prior Publication Data

US 2019/0161329 A1 May 30, 2019

(30) Foreign Application Priority Data

Nov. 28, 2017 (EP) ..... 17203997

(51) Int. Cl.

| | |
|---|---|
| ***B66F 9/06*** | (2006.01) |
| ***B66F 7/06*** | (2006.01) |
| ***B66F 9/065*** | (2006.01) |
| ***B66F 9/24*** | (2006.01) |

(52) U.S. Cl.

CPC ..... *B66F 9/063* (2013.01); *B66F 7/065* (2013.01); *B66F 7/0608* (2013.01); *B66F 7/0625* (2013.01); *B66F 9/065* (2013.01); *B66F 9/24* (2013.01)

(58) Field of Classification Search

CPC ..... B65G 1/137; B65G 35/00; B65L 39/12; B66F 7/0608; B66F 7/0625; B66F 7/065; B66F 9/063; B66F 9/065; B66F 9/24; B66F 5/00; B66F 7/00; B66F 7/0658; B66F 7/0666; B66F 9/06; B66F 9/07568; G05D 1/0088; B62D 65/18; B60S 9/00; B60S 9/14; B60S 9/21

USPC ..... 248/421; 254/2 C, 4 B, 5 B, 7 C, 8 B, 254/9 C, 95, 122, 123, 124, 126

See application file for complete search history.

(56) References Cited

U.S. PATENT DOCUMENTS

| | | | |
|---|---|---|---|
| 2,624,473 A | 1/1953 | Corder | |
| 2,825,477 A | 3/1958 | Ross | |
| 3,185,318 A | 5/1965 | Lewis, Sr. | |

(Continued)

FOREIGN PATENT DOCUMENTS

| | | | |
|---|---|---|---|
| BR | 202015017676 Y1 * | 1/2020 | ..... B62D 5/04 |
| CN | 104442518 A * | 3/2015 | |

(Continued)

OTHER PUBLICATIONS

KR 20160063830—Machine Transaltion (Year: 2016).*

(Continued)

*Primary Examiner* — Lee D Wilson
*Assistant Examiner* — Alberto Saenz
(74) *Attorney, Agent, or Firm* — Young Basile Hanlon & MacFarlane, P.C.

(57) ABSTRACT

An accessory device for use with an automated guided vehicle (AGV) to assist loading and unloading of components onto the AGV for transport by the AGV. In one example, an electric motor, two lifting devices and an inverted omega-shaped upper platform are used to selectively raise and lower the component. In another example an accessory is positioned on a central portion of the upper platform to engage a pallet to further assist loading, unloading and positioning of the pallet relative to the AGV.

16 Claims, 8 Drawing Sheets

(56) References Cited

U.S. PATENT DOCUMENTS

| | | | | | |
|---|---|---|---|---|---|
| 4,063,650 | A | | 12/1977 | Homer | |
| 4,137,984 | A | * | 2/1979 | Jennings | B62D 1/28 180/168 |
| 4,151,922 | A | | 5/1979 | Krumme | |
| 4,481,972 | A | | 11/1984 | Stavlo | |
| 4,496,274 | A | * | 1/1985 | Pipes | B66F 9/063 414/340 |
| 4,657,463 | A | * | 4/1987 | Pipes | B62D 1/24 180/167 |
| 4,815,190 | A | | 3/1989 | Haba, Jr. et al. | |
| 4,943,020 | A | | 7/1990 | Beaucoup et al. | |
| 5,091,855 | A | | 2/1992 | Umehara et al. | |
| 5,272,805 | A | | 12/1993 | Akeel et al. | |
| 5,658,120 | A | * | 8/1997 | Watanabe | B60G 3/00 414/495 |
| 6,045,122 | A | | 4/2000 | Torres | |
| 6,109,395 | A | * | 8/2000 | Storm | B66B 9/0869 187/200 |
| 6,278,905 | B1 | | 8/2001 | Saito | |
| 6,368,048 | B2 | | 4/2002 | Womble et al. | |
| 7,044,065 | B2 | | 5/2006 | Arai et al. | |
| 7,077,067 | B2 | | 7/2006 | Bodde et al. | |
| 7,416,130 | B2 | | 8/2008 | Kilibarda | |
| 8,201,723 | B2 | | 6/2012 | Kilibarda | |
| 8,713,780 | B2 | | 5/2014 | Kilibarda | |
| 8,869,370 | B2 | | 10/2014 | Kilibarda | |
| 9,014,902 | B1 | | 4/2015 | Murphy | |
| 9,540,181 | B2 | * | 1/2017 | Ghirardi | B65G 35/06 |
| 2005/0073767 | A1 | | 4/2005 | Goodman et al. | |
| 2009/0266275 | A1 | | 10/2009 | Feeney | |
| 2009/0285666 | A1 | | 11/2009 | Kilibarda | |
| 2010/0054901 | A1 | | 3/2010 | Lin | |
| 2011/0070061 | A1 | | 3/2011 | Scelfo | |
| 2011/0099788 | A1 | | 5/2011 | Kilibarda | |
| 2011/0101586 | A1 | | 5/2011 | Lands et al. | |
| 2011/0209321 | A1 | | 9/2011 | Kilibarda et al. | |
| 2011/0222999 | A1 | | 9/2011 | Kubota et al. | |
| 2011/0314665 | A1 | | 12/2011 | Kilibarda | |
| 2012/0110816 | A1 | | 5/2012 | Groves et al. | |
| 2012/0304446 | A1 | | 12/2012 | Kilibarda | |
| 2013/0184849 | A1 | | 7/2013 | Chan | |
| 2014/0259663 | A1 | | 9/2014 | Scelsi et al. | |
| 2015/0137567 | A1 | * | 5/2015 | Smith | A61G 5/1059 297/183.1 |
| 2021/0101790 | A1 | | 4/2021 | Kilibarda et al. | |

FOREIGN PATENT DOCUMENTS

| | | | | | |
|---|---|---|---|---|---|
| CN | 104442518 | A | | 3/2015 | |
| CN | 204374770 | U | * | 6/2015 | |
| CN | 205294021 | U1 | * | 9/2016 | B65G 1/04 |
| CN | 104442518 | B | * | 2/2017 | B60P 1/44 |
| CN | 206203291 | U | | 5/2017 | |
| CN | 105947506 | B | * | 8/2018 | B65G 35/00 |
| CN | 109515555 | A | * | 3/2019 | B62D 63/02 |
| DE | 202013004209 | U1 | * | 9/2013 | B66F 9/063 |
| GB | 2231687 | A | | 11/1990 | |
| KR | 20160063830 | A | * | 6/2016 | |
| WO | WO-2012108114 | A1 | * | 8/2012 | B65H 19/126 |
| WO | 2018005304 | A1 | | 1/2018 | |
| WO | WO-2018005304 | A1 | * | 1/2018 | |

OTHER PUBLICATIONS

European Search Report in corresponding EP15153558 dated Jul. 29, 2015.

Chinese Office Action dated May 5, 2016 in corresponding U.S. Appl. No. 13/903,527, English Translation.

* cited by examiner 1A
7A
40
M1
10
3
A
70

ACCESSORY MODULAR DEVICE FOR AGV

CROSS-REFERENCE TO RELATED APPLICATIONS

This application claims priority benefit to European Patent Application No. 17 203 997.6 filed on Nov. 28, 2017 the entire contents of which is incorporated by reference.

TECHNICAL FIELD

The present invention relates to automatic guided vehicles (AGV) used in the industrial field, for handling products and/or components typically within a production environment. In particular, the present invention relates to an accessory modular device designed to be mounted on board various types of AGV, for example, to facilitate loading onto, and unloading from, the AGV itself and/or to facilitate assembly operations that an operator must perform on the components transported by the AGV itself.

SUMMARY

The object of the present invention is to provide an accessory device for an AGV of the type indicated above, which can be easily implemented on different types of AGV and, at the same time, has a relatively simple and economical structure to produce.

A further object of the present invention is to provide an accessory device of the type indicated above, which has low overall dimensions and that can be adapted according to the operators interacting with the aforesaid device, depending on the production environment in which the AGV is intended to operate and depending on the types of components transported by the AGV.

In view of achieving the aforesaid objects, the present invention relates to an accessory device for an AGV, configured to be mounted onboard said AGV, for example, to facilitate loading onto, and unloading from, said AGV, of an object transported by said AGV, for example a pallet, said accessory device comprising:

- two lifting units arranged to be mounted above a base surface of said AGV, said lifting units being operative in a substantially vertical direction by the actuation of at least one first electric motor;
- an upper platform arranged above said lifting units and having end portions rigidly connected above said lifting units, in such a way that said upper platform can be raised or lowered by said lifting units;
- wherein said upper platform is substantially shaped like an inverted omega, so that it has a central portion lying in a plane that is lowered with respect to its end portions arranged above said lifting units.

Thanks to these characteristics, the accessory device according to the invention is able to implement a series of important advantages. Firstly, the adoption of a height-adjustable upper platform facilitates the interaction of an operator with the object transported by the AGV, for example, allowing an operator to perform assembly operations on the component transported by the AGV in ergonomic positions. Furthermore, thanks to the upper platform shaped like an inverted omega and therefore having a central portion lying in a plane that is lowered with respect to its end portions, it is possible to have a vertical dimension relatively contained. Finally, the omega shape of the upper platform makes it possible to arrange, within its central portion, useful accessories to further facilitate handling of the objects transported by the AGV and by the device.

According to a first preferred characteristic of the invention, the lifting units have a pantograph structure having a base portion arranged to be fixed above the base surface of the AGV, and a vertically movable upper portion. The base portion is substantially shaped like a rectangle and is fixed transversely above the base surface relative to the longitudinal direction of the AGV. Thanks to this characteristic, it is possible to limit the size of the accessory device, restricted to the dimensions of the upper plane of the AGV.

According to a further preferred characteristic of the invention, the device also comprises an accessory for further facilitating the movement of the object transported by the AGV. The accessory is arranged at the central portion of the upper platform.

In a first embodiment, the accessory is a roller conveyor equipped with an electric motor, and the lifting units are movable with a nut screw mechanism operated by means of a single electric motor which, with a transmission belt, moves the lifting units synchronously in the aforesaid vertical direction.

In a second embodiment, the accessory is a motorized revolving table.

In a third embodiment, a motorized revolving table is arranged at the central portion of the upper platform, and a roller conveyor is arranged above the motorized revolving table.

BRIEF DESCRIPTION OF THE DRAWINGS

Further characteristics and advantages of the invention will become apparent from the description that follows with reference to the attached drawings, provided purely by way of non-limiting example, wherein.

DETAILED DESCRIPTION

In the following description, various specific details are illustrated aimed at a thorough understanding of the embodiments. The embodiments can be implemented without one or more of the specific details, or with other methods, components, materials, etc. In other cases, known structures, constructive details, materials or operations are not illustrated and described in detail, since they can be produced in any known way, and also because they do not fall, taken in their own right, within the scope of the present invention.

It is also understood that in the following description, only the elements useful for understanding the invention are described, for example, assuming that the AGV on which the accessory devices are implemented according to the invention, comprises all the elements known per se for operation.

In the attached drawings, reference 1 indicates, in its entirety, a preferred embodiment of an accessory modular device according to the present invention for an AGV A. As known for some time, the term AGV means an automatic guided vehicle used mainly in the industrial field for handling products within a production environment, such as a production line.

Figure 1:
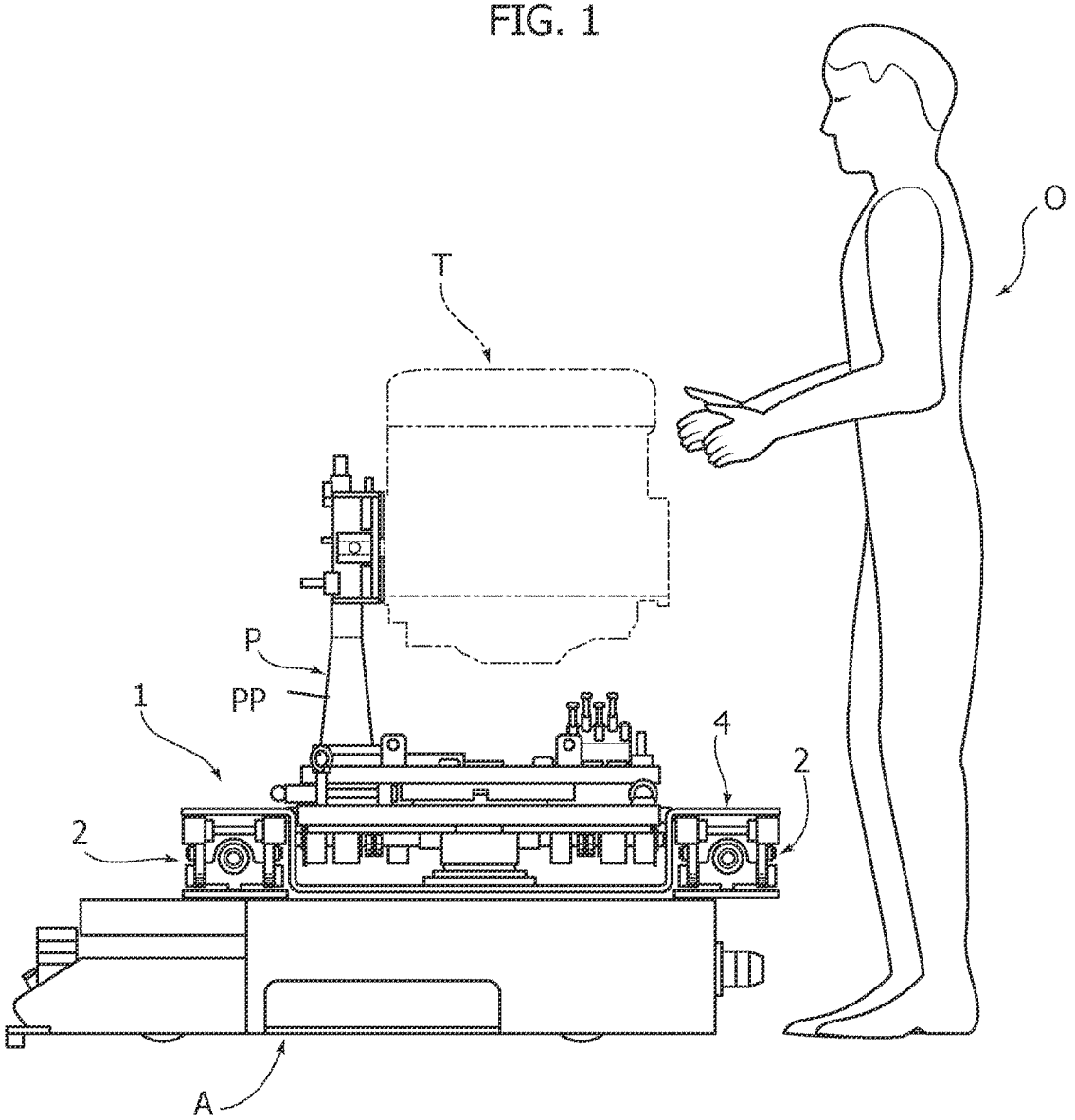
FIG. 1 is a schematic side view of an AGV with an example accessory device according to the invention.

The accessory device 1 according to the invention is configured to be mounted on board the AGV A, for example, to facilitate loading onto, and unloading from, said AGV, of an object transported by the AGV itself, for example object or component T (shown in phantom line) in FIG. 1. Exemplary component T is illustrated as supported by an exemplary pillar PP.

The AGV A has a base surface 3, on which both the accessory device 1, and an object to be handled within the production environment in which the AGV operates, can be mounted.

The AGV A illustrated in the drawings is provided herein purely by way of example, and it is evident that it can have any known configuration, different from that illustrated. Furthermore, the details relating to the technology with which the AGV operates within the production environment are not presented here because they are beyond the specific characteristics of the invention. The device according to the present invention is applicable to different types of AGV and is powered by AGV batteries. The device according to the invention can be used in different types of production environments such as, for example, a "stop-and-go" or a "continuously moving" production line.

Figure 2:
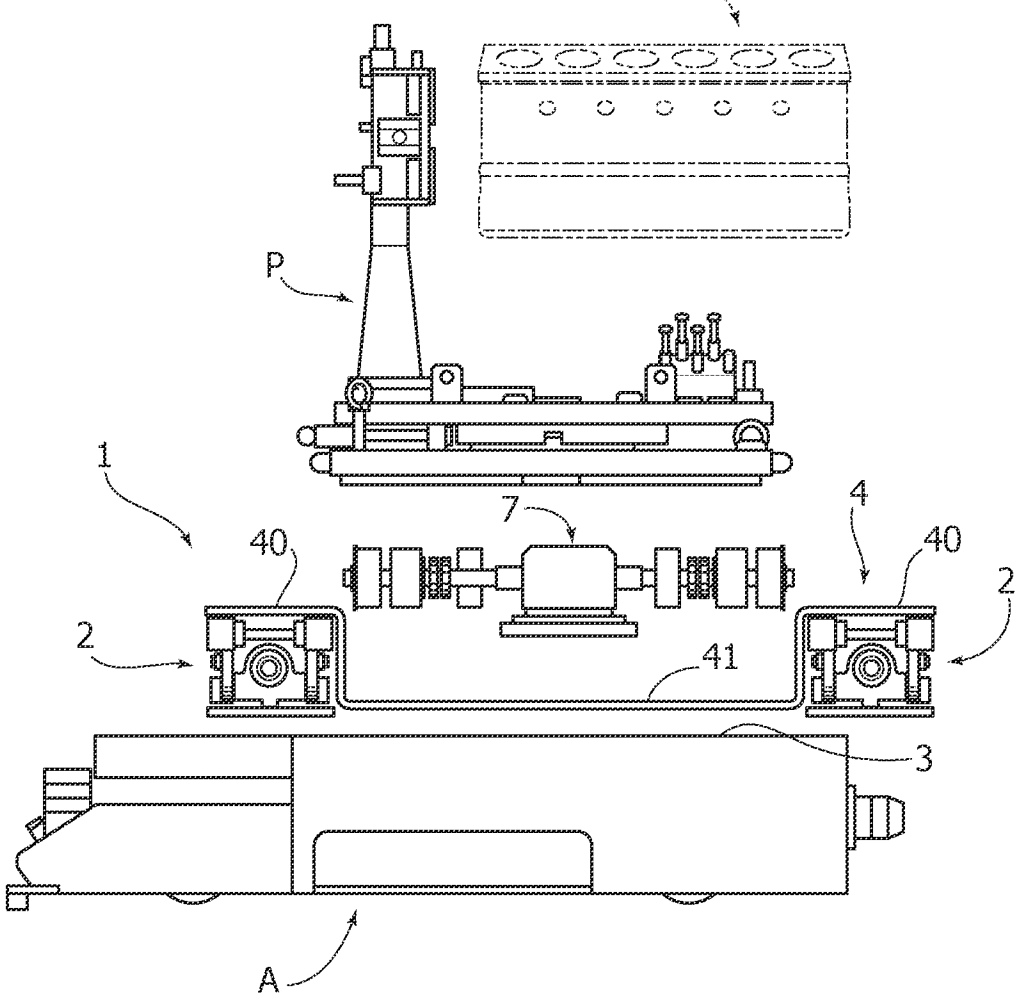
FIG. 2 shows an exploded schematic view of the elements illustrated in FIG. 1.

In the illustrated embodiment, with reference in particular to FIGS. 1 and 2, the AGV A, and the accessory device 1 associated with the AGV A, transport a pallet P. The pallet P is arranged, in turn, to carry a component (for example a cylinder head T shown in phantom lines). Typically, an operator O must manually perform assembly operations, and/or with the aid of electromechanical systems, on the components transported by the pallets P. Of course, the pallet P as depicted herein is also given by way of example, since the accessory device 1 can also be associated with other types of objects that are different from those illustrated.

With reference, in particular, to the exploded view of FIG. 2, the accessory device 1 according to the invention comprises two lifting units 2, arranged to be fixed above the base surface 3 of the AGV A. The lifting units 2 are operative in a vertical direction by the actuation of an electric motor M powered by means of the AGV batteries on which the device is applied.

The accessory modular device 1 according to the invention also comprises an upper platform 4 arranged above the lifting units 2. The upper platform 4 has two end portions 40, each of which is rigidly connected above a respective lifting unit 2, in such a way that the upper platform 4 can be raised or lowered by the lifting units 2.

According to an important characteristic of the present invention, the upper platform 4 is substantially shaped as an inverted omega, so that it has a central portion 41 that lies in a lowered plane with respect to its end portions 40 arranged above the lifting units 2 (FIG. 2).

Thanks to the characteristics of the device 1 according to the invention indicated above, the pallet P arranged at the central portion 41 of the upper platform 4 can be adjusted in a vertical direction. This characteristic makes it easier to load the transported parts onto, and unload from the AGV itself and/or to facilitate assembly operations that an operator must perform on the components transported by the AGV itself. A further advantage deriving from the above described structure of the device 1 is that of being able to adjust the height from the ground of the exemplary component cylinder head T associated with the example of the pallet P, in order to allow an operator O to perform machining and/or assembly operations in ergonomic positions. Furthermore, thanks to the inverted omega shape of the upper platform 4, the height from the ground of the pallet P is reduced compared to platforms with a substantially rectilinear profile, since the provision of a lowered central portion with respect to the end portions, mounted on the lifting units, allows limitation of the height due to implementing the device 1 on the base surface 3 of the AGV A.

According to a preferred characteristic of the invention, the accessory device 1 also comprises an accessory 7 to further facilitate the movement of the pallet P transported by the AGV A.

The exemplary accessory 7 is configured to be mounted at the central portion 41 of the upper platform 4. The omega shape of the upper platform 4 therefore has the additional advantage of allowing the arrangement of different types of accessories 7 at its central portion 41.

The distance between the two end portions 40 can be modified to position different sized accessories 7, pallets and components carried by the pallet.

Figures 4A, 4B:
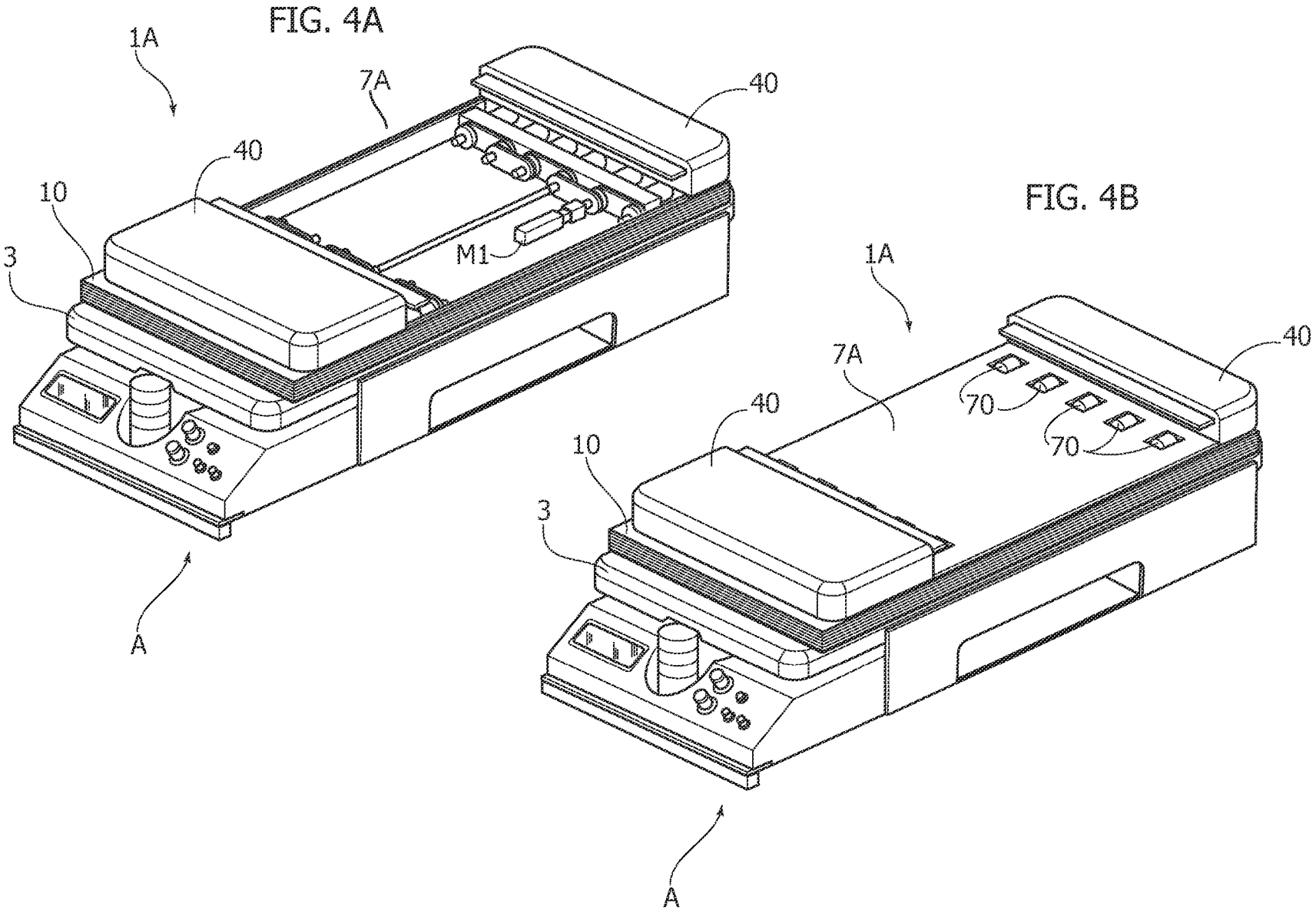
FIGS. 4A-4B illustrate two perspective views of alternate examples of the accessory device of the preceding figures including an exemplary accessory.
Figure 7A:
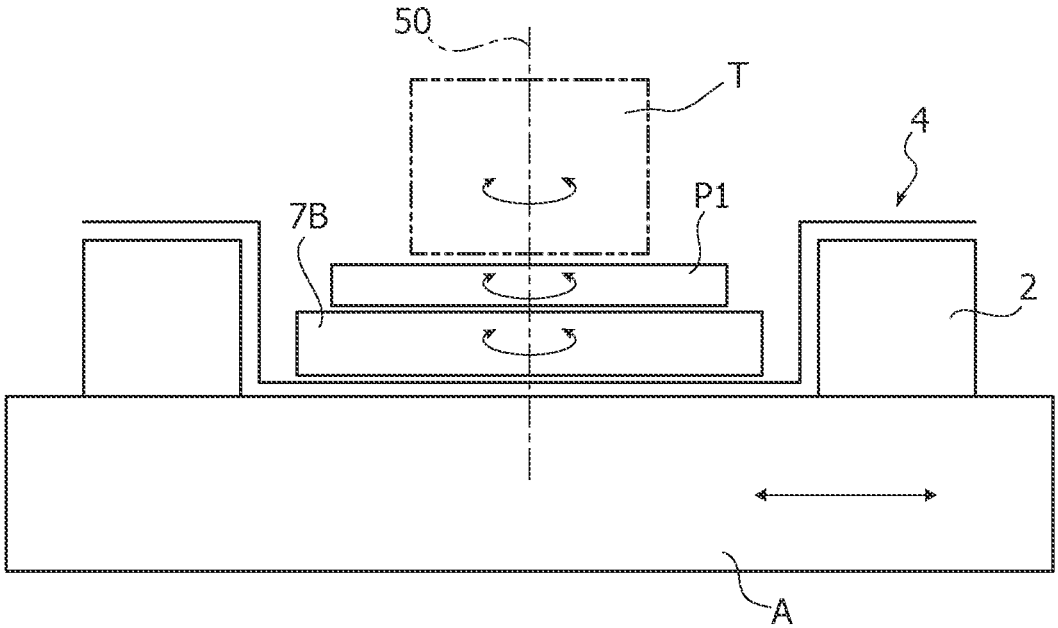
FIG. 7A illustrates a schematic side view of an alternate example of an accessory device.
Figure 7B:
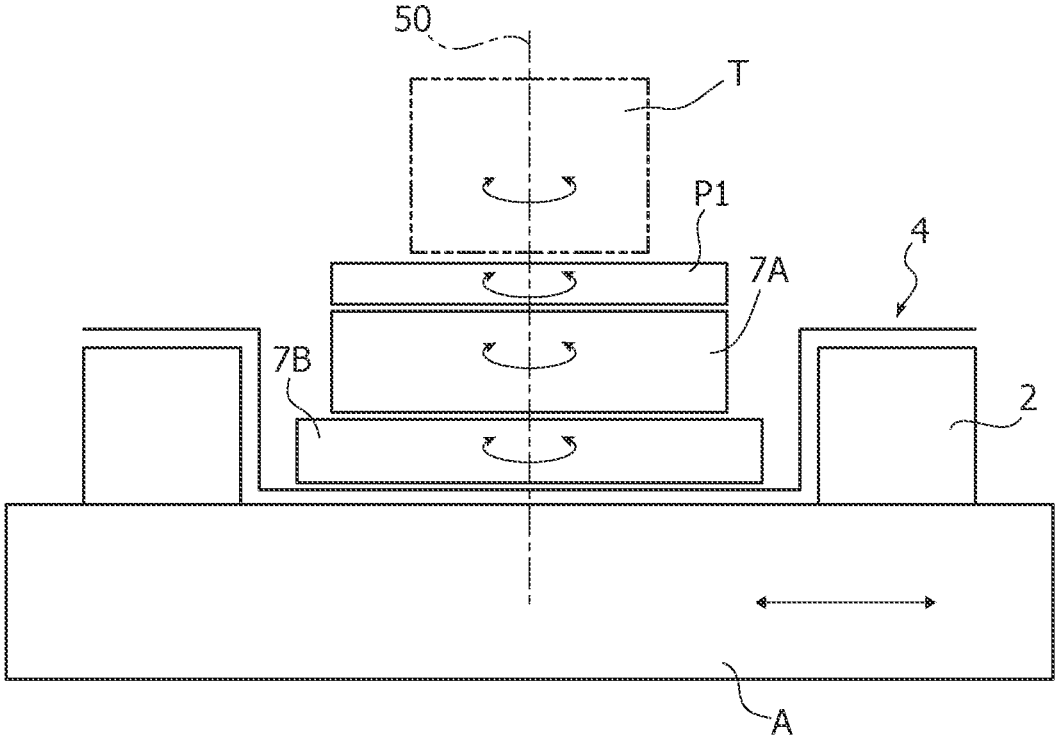
FIG. 7B illustrates a schematic side view of an alternate example of an accessory device.
Figure 7C:
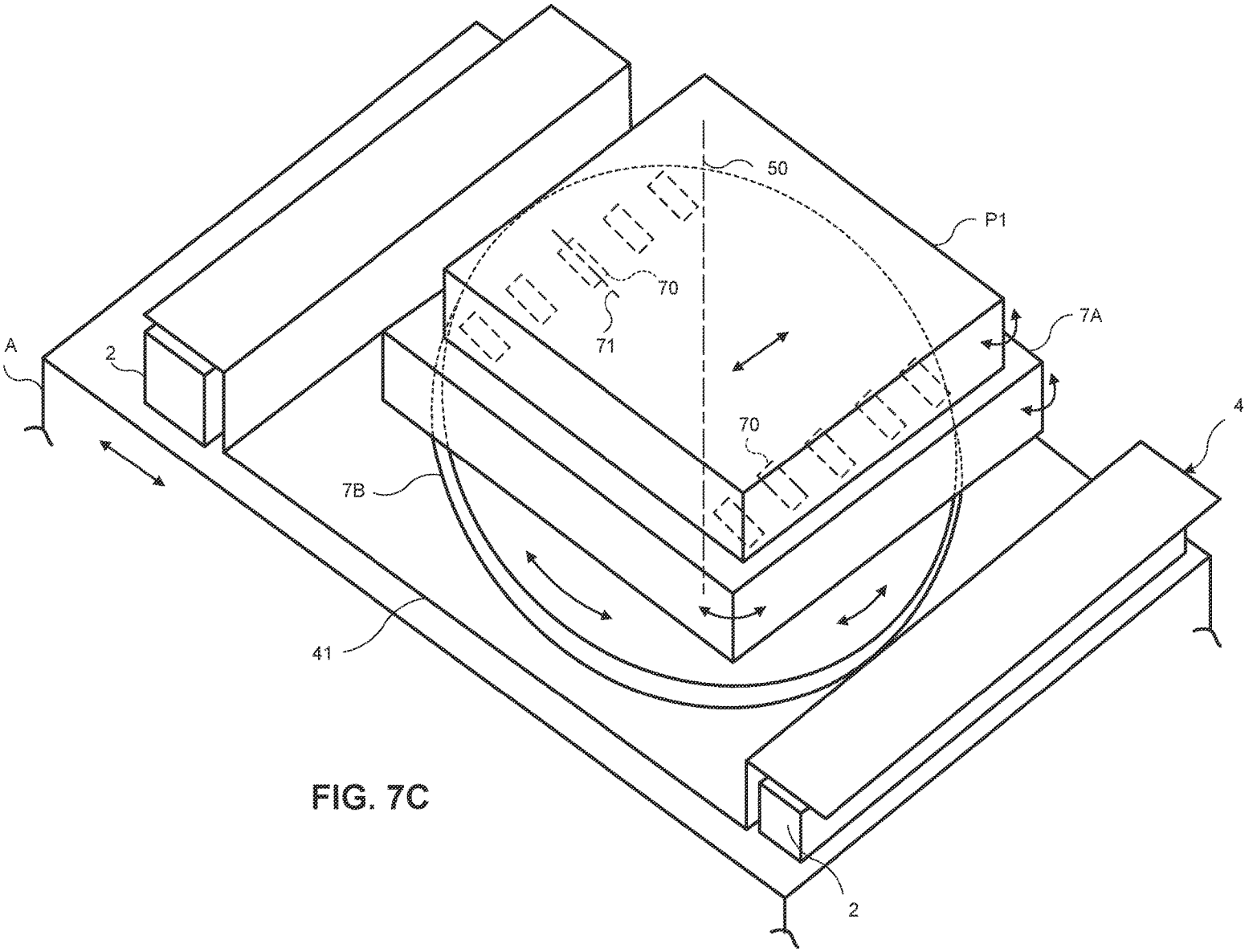
FIG. 7C illustrates a schematic partial perspective view of the example accessory device shown in FIG. 7B (shown without cylinder head T).

With reference, in particular, to FIG. 4A showing an alternate accessory device 1A (shown without accessory 7 cover or top) and 4B (shown with accessory 7 cover or top), the exemplary accessory 7 is a roller conveyor 7A equipped with an electric motor M1, but it can also be implemented in other embodiments (for example, a motorized revolving table 7B shown in FIGS. 7A, 7B and 7C). The exemplary roller conveyor 7A has a plurality of rollers 70 each having an axis of rotation 71 made for the object of further facilitating the loading onto, and unloading from, the AGV A of the pallet P, P1 (FIGS. 4B and 7C).

According to an alternative embodiment in FIGS. 7B and 7C, an alternate form of accessory 7 mounted at the central portion 41 of the upper platform 4 consists of a motorized revolving table 7B arranged at the central portion 41 of the upper platform 4, and of a roller conveyor 7A arranged above the motorized revolving table 7B. In this configuration, the height from the ground of the plane on which the pallet P1 is arranged is greater than in the embodiments in which the accessory 7 consists of just a roller conveyor 7A or a revolving table 7B, but in these cases the pallet P1 is able to rotate about an axis 50 freely above the upper platform 4 with an inverted omega shape comprising the two lifting units.

Figure 3B:
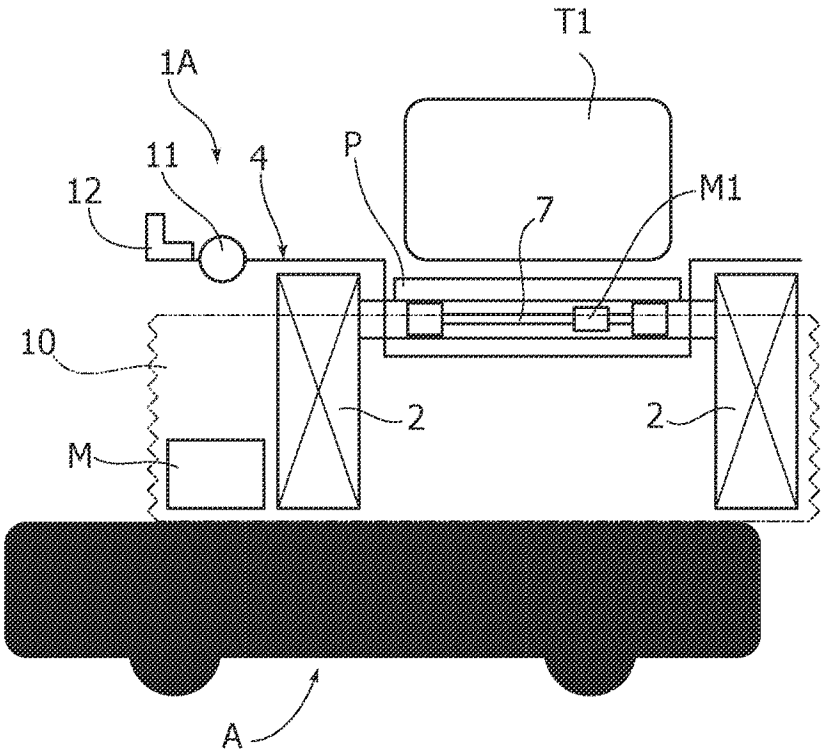
FIGS. 3A-3B are two additional schematic side views of alternate examples of the accessory device according to the invention, in its lowered condition and in its raised condition, respectively.
Figure 3A:
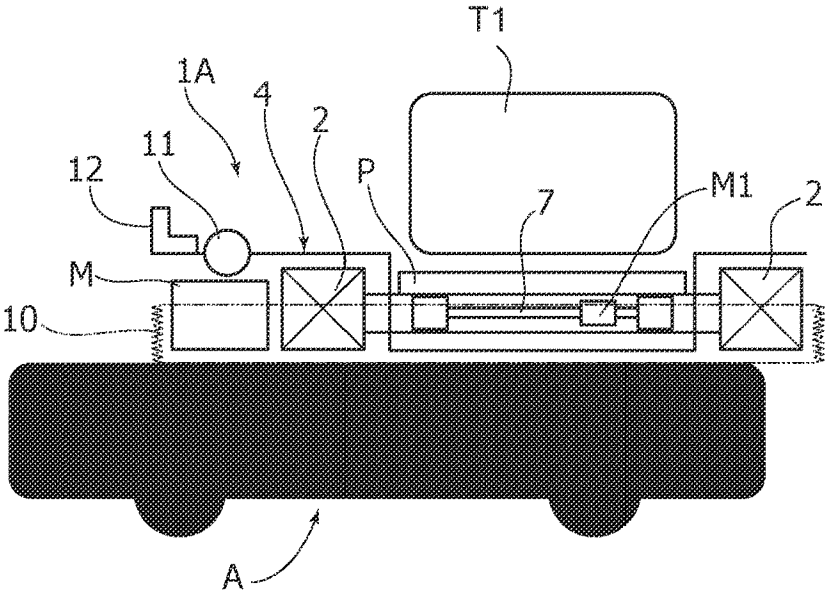

FIGS. 3A and 3B illustrate two schematic side views of an alternate example of the accessory device 1A (supporting an alternate component T1 schematically shown atop of the alternate pallet P1) in its lowered condition and in its raised condition, respectively. The accessory device 1A comprises a bellows 10 (shown in phantom line) having the function of covering the outside of the lifting units 2 and the electric motor M that feeds them. At the upper platform 4, there is also an electronic device 11 for detecting the position of the accessory device 1A associated with the AGV A, and a HMI interface 12 comprising a display and a manually controlled pushbutton panel, with which an operator O can interact.

According to an important characteristic of the invention, the accessory modular device 1A comprises a configurable electronic control unit for automatically operating the lifting units 2 and the accessory 7 according to a predetermined program. The electronic unit of the device 1A can be configured to communicate with an electronic unit of the AGV A. Alternatively, the lifting units 2 and the accessory 7 can be operated manually by an operator O by means of the aforesaid manually controlled pushbutton panel.

The device 1A also comprises a programmable electronic safety controller, configured for communicating with the AGV electronic unit, in order to automatically manage a series of safety functions required according to the specific application in which the accessory device 1 and the AGV A operate (for example, the automatic stop of the vertical movement of the lifting units). It is understood that the electronic device 11, HMI interface 12, the electronic control unit, and/or the programmable electronic safety controller may individually, selectively, or collectively, be used with each of the exemplary accessory devices described herein.

As previously mentioned, the device 1, 1A (and 1B below) can be interfaced with different types of AGV. The electric motors M, M1 are powered by means of the batteries of the AGV A to actuate the lifting units and/or the accessory 7.

Again, with reference to the example illustrated in FIGS. 3A-3B, 4A-4B, the end portions 40 of the platform 4 have different widths. Indeed, the end portion 40 with a greater width is arranged above the respective lifting unit 2 with which the electric motor M is associated, configured to synchronously move both lifting units 2. Moreover, the electronic control unit mentioned above is also provided at the end portion 40 with a greater width. With reference, in particular, to FIGS. 5A-6B, the structure and operation of the lifting units 2 will now be described in detail.

According to the preferred embodiment illustrated in the drawings, each lifting unit 2 has a base portion 5 mounted above the base surface 3 of the AGV A. The base portions 5 of the lifting units 2 have a substantially rectangular shape and are transversely fixed above the base surface 3 with respect to the longitudinal direction of the AGV A. Each lifting unit 2 comprises a screw 9 mounted in a freely rotatable manner between a first support element 8, and a second support element 13, each mounted at a respective end of the base element 5. The base portion 5 further comprises a nut 14 engaged with the screw 9. The nut 14 is slidably mounted on the base portion 5 and is free to move along the base portion 5 and not to rotate when the screw 9 is rotated. As will become clearer below, the screws 9 of the units 2 are synchronously driven by the electric motor M, by means of a transmission belt 24.

Figure 5B:
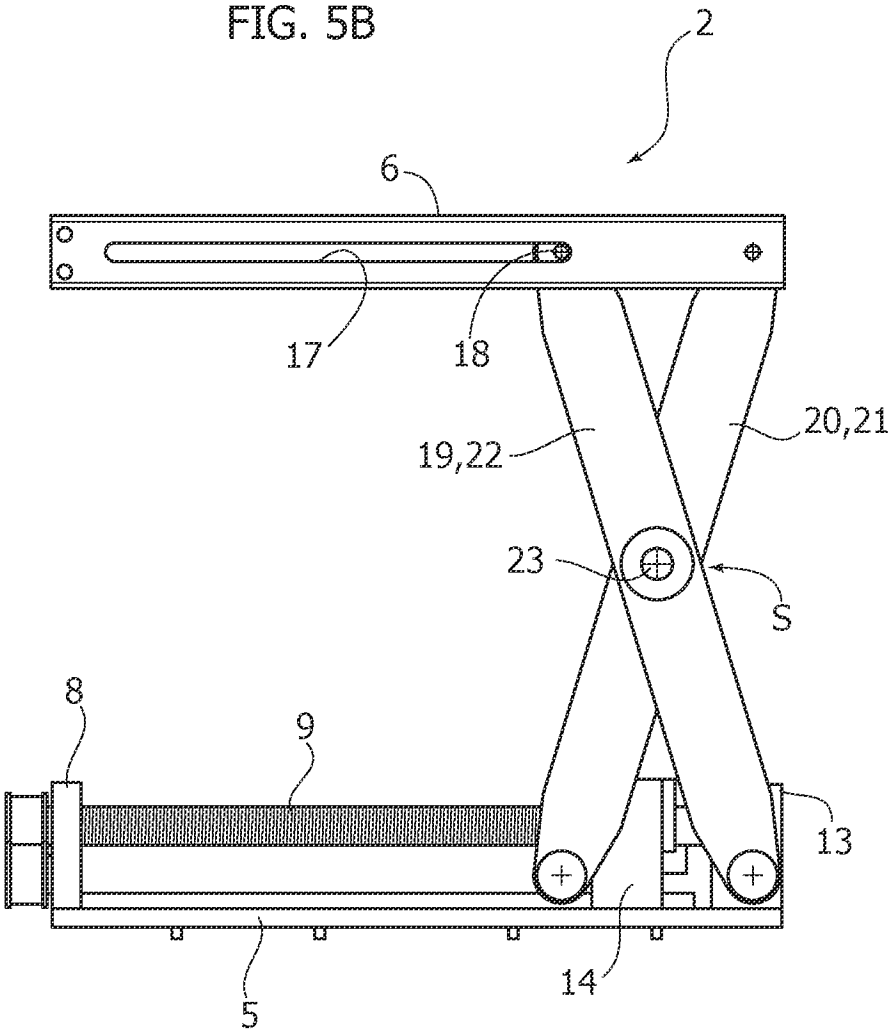
FIGS. 5A-5B illustrate, in detail, a perspective view and a front elevation view, respectively, of an example of a lifting unit forming part of the exemplary accessory devices illustrated in the previous figures.
Figure 5A:
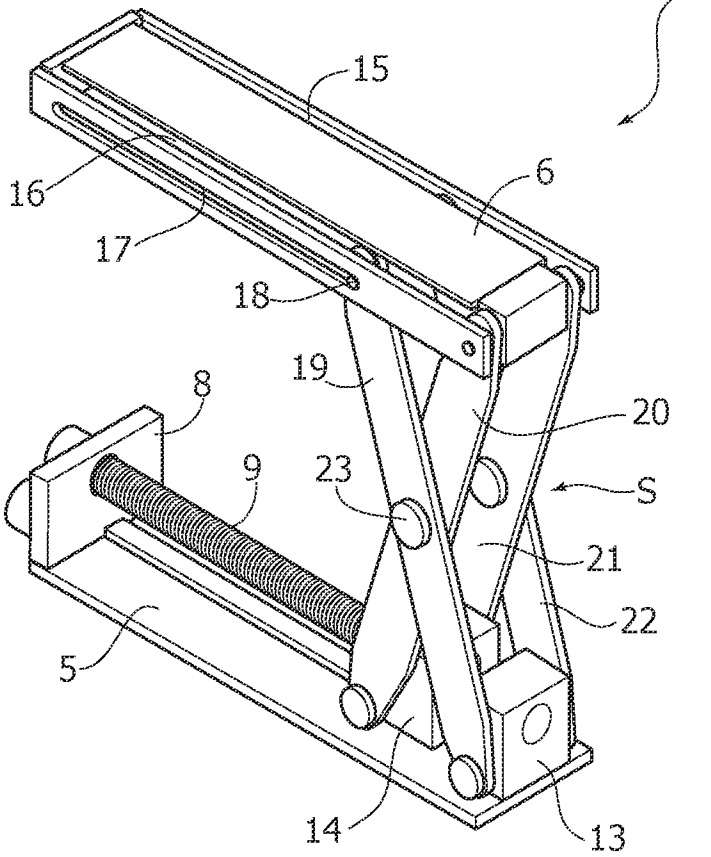

Each of the lifting units 2 further comprises a pantograph structure S and a vertically movable upper portion 6. The upper portion 6 has substantially the same shape and dimension as the base portion 5. The pantograph structure S is configured to lower or raise the upper portion 6 when the electric motor M drives the screw 9, which causes the axial displacement of the nut 14. The pantograph structure S consists of two pairs of rods (indicated by the references 19, 20 and 21, 22), which are mounted parallel to each other relative to the longitudinal direction of the base portion 5. As illustrated in FIG. 5A, each pair of rods has the two rods connected to each other by means of a pin 23 arranged at their centerline, and they have an X-shaped configuration when the upper portion 6 is in its raised position. Each pair of rods of the pantograph structure S consists of a first rod 19, 22 and a second rod 20, 21. The rods 19, 22 have a lower end rigidly connected to the support element 13 and an upper end slidably engaged in a slot 16 formed on the upper portion 6. The rods 20, 21 have their lower end rigidly connected to the nut 14 and their upper end rigidly connected to an end 60 of the upper portion 6. The upper ends of the rods 19, 22 each have a pin 18 slidably engaged in a second slot 17.

The lifting units 2 are movable in the vertical direction by means of a single electric motor M, which actuates the nut screw mechanism described above.

According to a specific embodiment, the mechanism can also be implemented by means of a recirculating ball screw. Both screws 9 of the lifting units 2 are actuated by means of a transmission belt 24. Following rotation of the screw 9, the nut 14 moves axially along the base portion 5. Movement of the nut 14 causes displacement of the rods 20, 22 which, in turn, cause the upper platform 6 to be lowered or raised. Following lowering or lifting of the upper portion 6, the pins 18 of the rods 19, 22 slide into the slots 17 provided on the upper platform 6, and the rods 19, 22 are also free to move towards the raised or lowered condition.

Figure 6B:
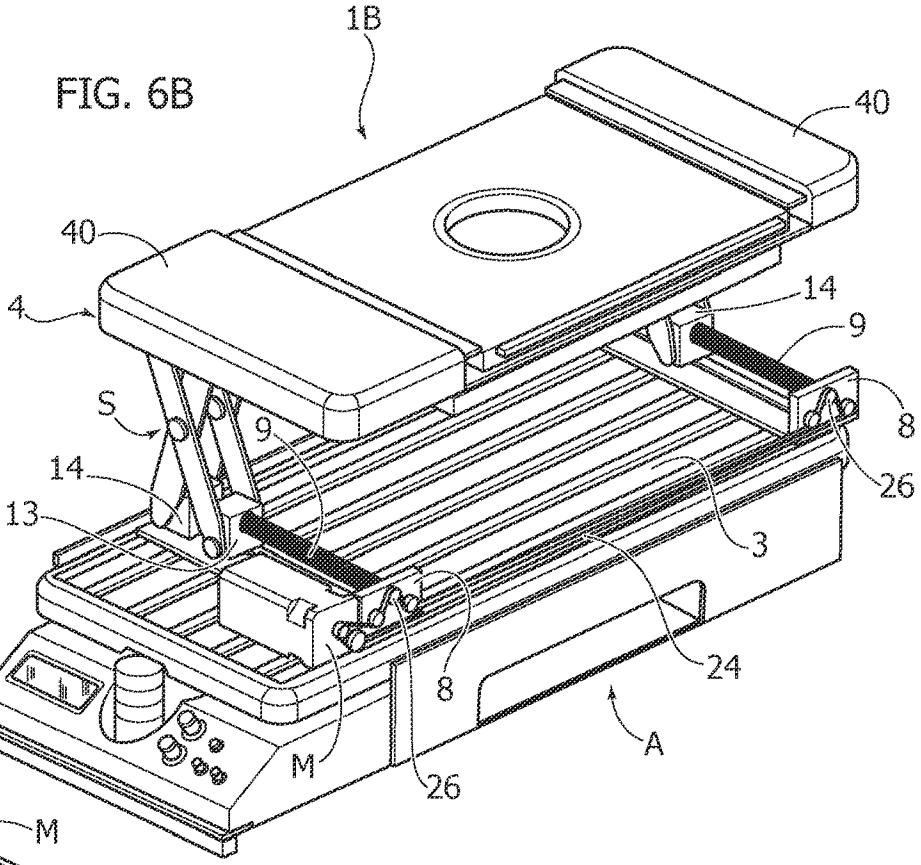
FIGS. 6A-6B illustrate two further alternate perspective views of alternate examples of the accessory device of the preceding figures in its raised condition.
Figure 6A:
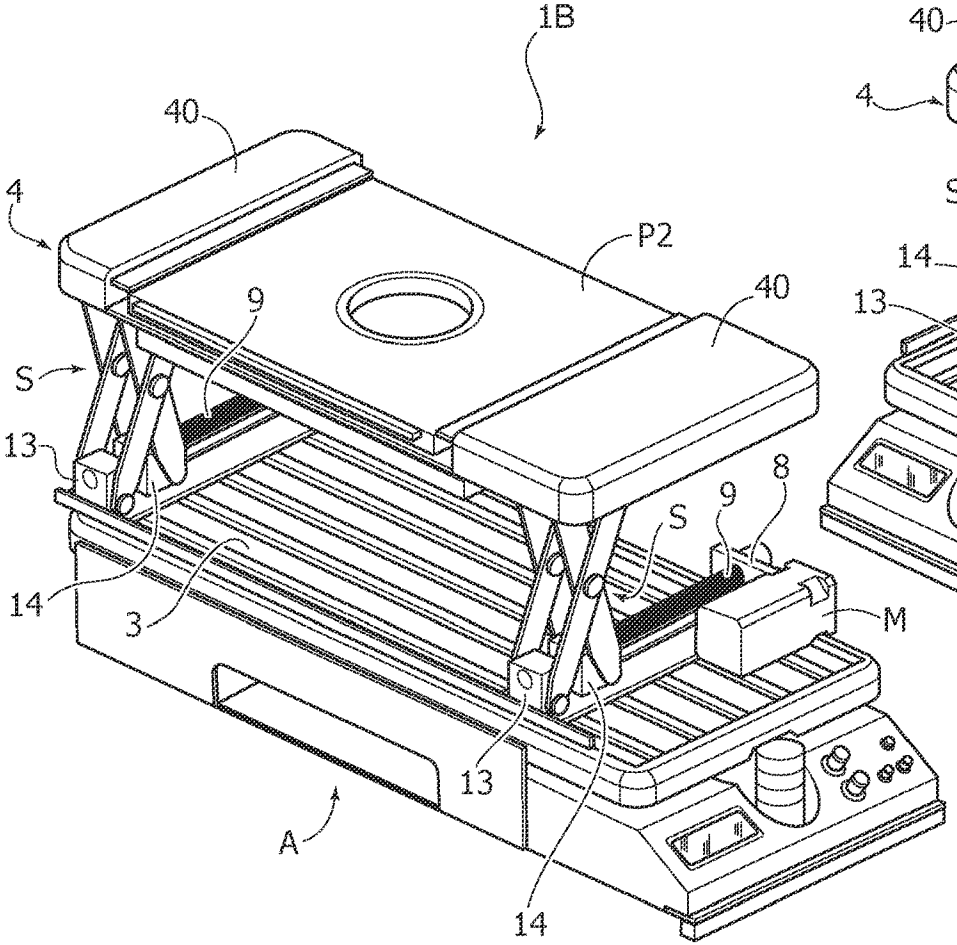

As illustrated in the example accessory device 1B and pallet P2 shown in FIG. 6B, a belt 24 is engaged at the outlet of the electric motor M, and at each of the lifting units, by means of a plurality of pulleys 26 arranged at each support element 8.

As is evident from the foregoing description, the accessory device according to the invention achieves a series of important advantages.

First of all, the accessory modular device makes it possible to move an object transported by the AGV in a vertical direction, by means of a relatively simple structure that is easily adaptable on different types of AGV.

Secondly, the provision of an upper platform 4 substantially shaped like an omega, allows the central portion to be lower with respect to the end portions, and this allows obtainment of a relatively reduced height from the ground of the objects transported by the AGV, and also to have a seat (central portion of the upper platform 4) to accommodate an additional accessory configured to further facilitate handling of the objects transported by the device and the AGV.

A further advantage of the present invention is that of being able to automatically or manually adapt the height of the object transported by the AGV so that an operator can interact with said object in ergonomic positions. The lifting units 2 can also be automatically activated during an operative moving step of the AGV A.

Finally, the present invention is applicable to different types of AGV and can be used in different types of production environments such as, for example, a "stop-and-go" or a "continuously moving" production line.

Of course, without prejudice to the principle of the invention, the details of construction and the embodiments may vary widely with respect to those described and illustrated, without departing from the scope of the present invention. For example, the lifting units can have a different type of pantograph structure than that illustrated, and the units can be fed by different electric motors (one electric motor for each lifting unit).

What is claimed is:

1. An accessory modular device for use onboard an automated guided vehicle (AGV) to facilitate loading and unloading of a pallet onto and from the AGV for transport by said AGV, said accessory modular device comprising:

two lifting units arranged to be mounted above a base surface of said AGV and positioned transverse to a longitudinal direction of the AGV, said lifting units selectively movable in a substantially vertical direction by actuation of at least one first electric motor;

an upper platform positioned above said two lifting units and having end portions positioned transverse to the longitudinal direction of the AGV, each of the end portions respectively positioned above and rigidly connected to one of said two lifting units, in such a way that said upper platform can selectively be raised or lowered by said lifting units along the substantially vertical direction, wherein said upper platform is substantially shaped like an inverted omega, comprising a central portion connected to said end portions, said end portions each having a distal end extending outwardly from said central portion along the longitudinal direction of the AGV, said central portion operable to support the pallet, the central portion lying in a plane that is positioned vertically lower with respect to said end portions, the central portion positioned transverse to the longitudinal direction of the AGV and defining a through passageway through the central portion in the transverse direction relative to the AGV longitudinal direction, the through passageway operable for selective loading and unloading of the pallet onto the central portion from each side of the AGV in the direction transverse to the longitudinal direction of the AGV;

a first accessory and a second accessory each configured to selectively facilitate movement of the pallet relative to the upper platform, the second accessory is configured to move the pallet in a different direction relative to the upper platform than the first accessory, the accessory modular device is configured to alternately receive on the central portion a selected one of the first accessory or the second accessory suitable for a particular production environment;

a configurable electronic control unit operable to automatically control movement of the two lifting units in the substantially vertical direction and movement of the selected one of the first accessory or the second accessory according to a predetermined program, the configurable electronic control unit is further operable to communicate with an electronic unit of the AGV; and a safety electronic controller in communication with the at least one first electric motor configured and operable to manage a plurality of safety functions specific to each of the selected one of the first accessory or the second accessory positioned on the central portion of the upper platform.

2. The accessory device according to claim 1, wherein each of said two lifting units includes a pantograph structure further comprising a base portion fixed above said base surface of said AGV and a vertically-movable upper portion, said base portion having a substantially rectangular shape and being transversely positioned with respect to the longitudinal direction of said AGV.

3. The accessory device according to claim 2 further comprising:

a nut screw mechanism engaged with each of the two lifting units; and a transmission belt engaged with each nut screw mechanism and the at least one first electric motor operable to selectively move said two lifting units synchronously in the substantially vertical direction.

4. The accessory device according to claim 3, wherein said pantograph structure comprises two pairs of rods each pair comprising a first rod and a second rod, wherein said first rod includes a lower end rotatably connected to a support element and an upper end slidably engaged in a slot defined by an upper portion of said pantograph structure, and wherein said second rod includes a lower end rotatably connected to a nut and an upper end rotatably connected to an end of said upper portion of said pantograph structure.

5. The accessory device according to claim 1, wherein said second accessory comprises a roller conveyor having a plurality of rollers having an axis of rotation substantially parallel with the longitudinal direction of the AGV, said roller conveyor operable to selectively facilitate loading or unloading of said pallet onto or from said AGV upper platform central portion in the transverse direction from each side of the AGV relative to the AGV longitudinal direction.

6. The accessory device according to claim 5, wherein said roller conveyor comprises at least one second electric motor engaged with said plurality of rollers, the at least one second electric motor operable to selectively rotate said rollers.

7. The accessory device of claim 1 wherein the pallet further comprises a pillar extending vertically upward from a pallet base abuttingly engaged with the accessory, the pillar removably engaged with a component cantilevered over the pallet base, the accessory device operable to selectively position the component at a height along the substantially vertical direction for an operator to conduct work on the component.

8. The accessory device according to claim 1, wherein one of the plurality of safety functions comprises automatically stopping movement of the two lifting units along the substantially vertical direction.

9. The accessory device according to claim 1, wherein said first accessory comprises a revolving table arranged the central portion of the upper platform and is configured to rotate about an axis to rotatably move the pallet relative to the upper platform.

10. The accessory device according to claim 9, wherein the second accessory further comprises a roller conveyor arranged on and positioned above the revolving table, the roller conveyor is configured to laterally move the pallet relative to the revolving table and the upper platform.

11. The accessory device according to claim 10, wherein the revolving table and the roller conveyor position the pallet above the end portions of the upper platform allowing the pallet to rotate about the axis without contact or interference with the upper platform.

12. An accessory modular device for use onboard an automated guided vehicle (AGV) to facilitate loading and unloading of a component onto and from the AGV for transport by said AGV, said accessory device comprising:

an electric motor supported by a base surface of an AGV;

two lifting units supported by the base surface of the AGV and positioned transverse to a longitudinal direction of the AGV, each of the two lifting units further comprising:

an elongate threaded screw threadably engaged with a nut and a first support element, the threaded screw further engaged with the electric motor;

a pantograph structure comprising two pairs of rods each pair comprising a first rod and a second rod, wherein said first rod includes a lower end rotatably connected to a second support element and an upper end slidably engaged in a slot defined by an upper portion of said pantograph structure, and wherein said second rod includes a lower end rotatably connected to the nut engaged with the threaded screw and an upper end rotatably connected to an end of said upper portion of said pantograph structure, the pantograph structure upper portion selectively operable to move along a vertical direction on rotation of the threaded screw by the electric motor;

an upper platform having a central portion and opposing end portions positioned vertically above the central portion and positioned transverse to the longitudinal direction of the AGV, the opposing end portions each having a distal end extending outwardly from said central portion along the longitudinal axis, the central portion positioned transverse to the longitudinal direction of the AGV and defining a through passageway through the central portion operable for the component to be selectively loaded and unloaded from the central portion from each side of the AGV in the direction transverse to the AGV longitudinal direction, each opposing end portion connected to a respective one of the two lifting units, the central portion operable to support the component accessible by an operator, the lifting units operable to selectively position the component at a desired height in the vertical direction for the operator; and the upper platform central portion operable to receive a selected one of an accessory from different types of accessories positioned on the upper platform central portion, the accessory operable to engage the component for the selective movement of the component relative to the upper platform in the direction transverse to the AGV longitudinal direction to load or unload the component from each side of the AGV.

13. The accessory device according to claim 12, wherein said accessory comprises a roller conveyor having a plurality of rollers having axes of rotation substantially parallel with the AGV longitudinal direction, said roller conveyor operable to selectively facilitate the component loading onto or unloading from said AGV upper platform central portion from each side of the AGV in the transverse direction relative to the AGV longitudinal direction.

14. The accessory device of claim 12 wherein the upper platform opposing end portions comprise a first end portion and a second end portion each connected to the central portion, the first end portion having a length extending along the AGV longitudinal direction greater than a length of the second end portion extending along the AGV longitudinal direction.

15. The accessory device of claim 12, further comprising:

a configurable electronic control unit operable to automatically control movement of the two lifting units and movement of the accessory according to a predetermined program, the configurable electronic control unit is further operable to communicate with an electronic unit of the AGV; and a safety electronic controller in communication with the electric motor configured and operable to manage a plurality of safety functions specific to each selected accessory of the different types of accessories positioned on the central portion of the upper platform.

16. An accessory device for use onboard an automated guided vehicle (AGV) to facilitate loading and unloading of a pallet onto and from the AGV for transport by said AGV, said accessory device comprising:

two lifting units arranged to be mounted above a base surface of said AGV, said lifting units selectively movable in a substantially vertical direction by actuation of at least one first electric motor;

an upper platform positioned above said two lifting units and having end portions each respectively positioned above and rigidly connected to one of said two lifting units, in such a way that said upper platform can selectively be raised or lowered by said lifting units along the substantially vertical direction, wherein said upper platform is substantially shaped like an inverted omega, comprising a central portion connected to said end positions, said central portion operable to support the pallet, the central portion lying in a plane that is positioned vertically lower with respect to said end portions, the central portion positioned transverse to a longitudinal direction of the AGV and defining a through passageway through the central portion in the transverse direction relative to the AGV longitudinal direction, the through passageway operable for selective loading and unloading of the pallet onto the central portion from each side of the AGV in the direction transverse to the longitudinal direction of the AGV, and wherein the upper platform end portions comprise a first end portion and a second end portion each connected to the central portion, the first end portion having a length extending along the AGV longitudinal direction greater than a length of the second end portion extending along the AGV longitudinal direction.

* * * * *